US008222817B2

(12) United States Patent
Homma et al.

(10) Patent No.: US 8,222,817 B2
(45) Date of Patent: Jul. 17, 2012

(54) ARC TUBE FOR DISCHARGE BULB AND DISCHARGE BULB INCLUDING THE SAME

(75) Inventors: Akira Homma, Shizuoka (JP); Masato Harazaki, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 13/272,431

(22) Filed: Oct. 13, 2011

(65) Prior Publication Data

US 2012/0091891 A1 Apr. 19, 2012

(30) Foreign Application Priority Data

Oct. 14, 2010 (JP) ..... 2010-231066

(51) Int. Cl.
*H01J 17/18* (2012.01)
*H01J 61/36* (2006.01)

(52) U.S. Cl. .... 313/623; 313/631; 313/575; 313/318.07

(58) Field of Classification Search ..... 313/623–625, 313/631–632, 318.07, 574–575; 445/26, 445/27

See application file for complete search history.

(56) References Cited

U.S. PATENT DOCUMENTS

| | | | | |
|---|---|---|---|---|
| 2005/0003729 | A1* | 1/2005 | Mizobe | 445/22 |
| 2009/0121635 | A1* | 5/2009 | Nagamachi et al. | 313/631 |
| 2010/0201266 | A1* | 8/2010 | Kasaishi et al. | 313/623 |
| 2010/0270921 | A1* | 10/2010 | Shirakawa et al. | 313/623 |

FOREIGN PATENT DOCUMENTS

| | | | |
|---|---|---|---|
| JP | 5-159744 | A | 6/1993 |
| JP | 2006196267 | A * | 7/2006 |

* cited by examiner

*Primary Examiner* — Mariceli Santiago
(74) *Attorney, Agent, or Firm* — Sughrue Mion, PLLC

(57) ABSTRACT

An arc tube for a discharge bulb includes: an electrode assembly that has an electrode bar and a molybdenum foil, wherein an overlapping portion of an end portion of the electrode bar and a molybdenum foil is joined by spot welding; a pinch seal portion that seals a part of the electrode assembly, the part including at least the molybdenum foil; and a closed glass bulb, into which a tip of the electrode bar protrudes, the closed glass bulb forming a discharge light-emitting portion, wherein the size of a recess, which is a weld mark, in the molybdenum foil on the side opposite to a joint portion, at which the molybdenum foil and the electrode bar are joined with each other, is within a range from 0.07 $mm^2$ to 0.25 $mm^2$.

13 Claims, 12 Drawing Sheets

RELATION BETWEEN SIZE OF NUGGET AND WELD STRENGTH
(NUMBER OF TESTS: TEN FOR EACH SIZE)

| SIZE OF NUGGET ($mm^2$) | 0.05 | 0.06 | 0.07 | 0.08 |
|---|---|---|---|---|
| WELD STRENGTH (Kgf) | 0.38 | 0.44 | 0.55 | 0.72 |

RELATION BETWEEN SIZE OF NUGGET AND FOIL CRACK OCCURRENCE TIME (NUMBER OF TESTS: TEN FOR EACH SIZE)

| SIZE OF NUGGET ($mm^2$) | 0.15 | 0.2 | 0.25 | 0.3 | 0.35 |
|---|---|---|---|---|---|
| FOIL CRACK (*hour*) | 3000 | 3000 | 2580 | 1800 | 1200 |

RELATION BETWEEN DISTANCE BETWEEN COIL AND MOLYBDENUM FOIL AND ELECTRODE CRACK OCCURRENCE NUMBER (NUMBER OF TESTS: THIRTY FOR EACH DISTANCE)

| DISTANCE BETWEEN COIL AND MOLYBDENUM FOIL | 0.3 | 0.4 | 0.5 | 0.6 | 0.7 | 0.8 |
|---|---|---|---|---|---|---|
| ELECTRODE CRACK OCCURRENCE NUMBER (NUMBER OF CRACKS) | 0 | 0 | 0 | 1 | 5 | 7 |

ARC TUBE FOR DISCHARGE BULB AND DISCHARGE BULB INCLUDING THE SAME

INCORPORATION BY REFERENCE

The disclosure of Japanese Patent Application No. 2010-231066 filed on Oct. 14, 2010 including the specification, drawings and abstract is incorporated herein by reference in its entirety.

BACKGROUND OF THE INVENTION

1. Field of the Invention

The present invention relates to a discharge bulb that is used as a light source for an automobile headlamp, for example, and an arc tube that is used in the discharge bulb.

2. Description of Related Art

This kind of arc tube for a discharge bulb includes a pair of pinch seal portions, in each of which an electrode assembly having an electrode bar and a molybdenum foil joined in series is sealed, and a closed glass bulb that is a discharge light-emitting portion and in which a pair of electrodes are disposed to be opposed to each other and a luminous substance and the like are enclosed, the closed glass bulb being interposed between the pinch seal portions.

In the electrode assembly, the molybdenum foil and the electrode bar are joined by spot welding and examples of the spot welding include the resistance welding described in Japanese Patent Application Laid-Open (Kokai) No. 05-159744 (JP-A-05-159744) (see paragraphs 0009 to 0011, FIGS. 1, 2, and 5), for example.

In JP-A-5-159744, the overlapping portion of the molybdenum foil and the electrode bar is sandwiched by a pair of welding electrodes and a large electric current is caused to flow between the welding electrodes with the overlapping portion subjected to a high pressure exerted by the pair of welding electrodes, whereby welding is performed.

In particular, when the spot welding is performed, an angular end portion of the electrode bar and the molybdenum foil are pressed against each other, which tends to damage the molybdenum foil by causing a crack, for example, which in turn tends to cause breakage of the foil when the electrode assembly is pinch-sealed. Thus, the overlapping portion of the molybdenum foil and the electrode bar is spot welded at the point with a small margin left at the end of the electrode bar, thereby suppressing the damage of the molybdenum foil (breakage of the foil at the time of pinch sealing) caused by welding.

In JP-A-05-159744, however, a weld mark called a nugget can appear in the molybdenum foil in the form of a recess on the side opposite to the joint portion, at which the molybdenum foil and the electrode bar are joined with each other by spot welding and in this case, glass enters the nugget (recess) in the pinch seal portion. When thermal stress concentrates at the entering portion, at which the glass layer enters the nugget, at the time of turning on or off the bulb (arc tube), a crack can occur in the vicinity of the nugget, which can lead to reduction in lifetime of the bulb.

In particular, in the case of the mercury-free arc tube, in which mercury effective in raising the tube voltage is not enclosed in the closed glass bulb, in order to compensate for the reduced tube voltage as compared to the mercury-containing arc tube, the tube current is increased to obtain enough power and the large electric current imposes a high load on the electrode (bar). When such a large electric current makes the temperature of the electrode (bar) high, the thermal stress (thermal strain) that occurs at the interface between the molybdenum foil and the glass is large and the crack that runs from the glass portion near the nugget occurs more easily.

SUMMARY OF THE INVENTION

The present invention provides an arc tube for a discharge bulb that is excellent in weld strength between an electrode bar and a molybdenum foil at the time of pinch sealing and in which cracks are less prone to occur in a pinch seal portion, and also provides a discharge bulb including the arc tube.

A first aspect of the present invention is an arc tube for a discharge bulb including: an electrode assembly that has an electrode bar and a molybdenum foil, wherein an overlapping portion of an end portion of the electrode bar and a molybdenum foil is joined by spot welding; a pinch seal portion that seals a part of the electrode assembly, the part including at least the molybdenum foil; and a closed glass bulb, into which a tip of the electrode bar protrudes, the closed glass bulb forming a discharge light-emitting portion, wherein a size (length×width) of a recess, which is a weld mark, in the molybdenum foil on a side opposite to a joint portion, at which the molybdenum foil and the electrode bar are joined with each other, is within a range from 0.07 $mm^2$ to 0.25 $mm^2$.

A second aspect of the present invention is a discharge bulb including the arc tube for a discharge bulb according to the above first aspect.

The inventors first considered that there is a correlation between the size (length×width) of the nugget and the time (lifetime of the bulb), at which a crack that runs from the vicinity of the nugget occurs in the pinch seal portion, and that there is a correlation between the size of the nugget and the weld strength of the spot welded portion. Then, the inventors got an idea that if there is a correlation between the size of the nugget and the occurrence of a crack and there is a correlation between the size of the nugget and the weld strength, it may be possible to control the occurrence of a crack in the pinch seal portion by adjusting the size of the nugget (by adjusting the weld pressure and/or the electric power for welding, for example) based on these correlations.

The inventors studied the correlations as described above and have found that the size of the nugget and the weld strength of the spot welded portion have a correlation as shown in FIG. 8 (the size of the nugget and the weld strength are substantially proportional to each other) and the size of the nugget and the time (lifetime of the bulb), at which a crack that runs from the vicinity of the nugget occurs in the pinch seal portion, have a correlation as shown in FIG. 9 (the size of the nugget and the bulb lifetime are substantially inversely proportional to each other).

Since the size of the nugget is proportional to the weld strength and is inversely proportional to the crack occurrence time, the inventors considered that an arc tube for a discharge bulb that is excellent in weld strength between an electrode bar and a molybdenum foil at the time of pinch sealing and in which a crack is less prone to occur in a pinch seal portion, would be obtained by determining the size of the nugget based on both the weld strength and the crack occurrence time. In this way, the inventors have made the present invention.

Examples of spot welding include resistance welding and laser welding. In the case of the resistance welding, the surfaces of the molybdenum foil and the electrode bar to be jointed are welded while the surfaces are pressed and in the case of the laser welding, the surfaces of the molybdenum foil and the electrode bar is subjected to the application of laser light from the side of the molybdenum foil opposite to the surface to be joined. Thus, in any of these cases, a weld mark (recess) called a nugget is formed in the molybdenum foil on the side opposite to the joint portion, at which the molybdenum foil and the electrode bar of the electrode assembly are joined with each other by spot welding (see FIG. 5).

When the size of the weld mark (the size of one weld mark in the case of resistance welding or the size of the entire region of a series of a plurality of weld marks in the case of laser welding) is less than 0.07 $mm^2$, the area of the joint portion between the molybdenum foil and the electrode bar is so small that the bonding strength (weld strength) is insufficient and the molybdenum foil and the electrode bar can come off each other when the electrode assembly is pinch-sealed. As a result, in some cases, the electrode assembly does not function as the path for electric current (the arc tube is not lit).

Specifically, from the results of the tensile tests of the electrode assemblies, the size of the weld mark and the weld strength of the spot welded portion are substantially proportional to each other as shown in FIG. 8 (the larger the size of the weld mark is, the higher the weld strength of the spot welded portion is). When the weld strength is less than 0.5 kgf, the molybdenum foil can come off the electrode bar at the time of pinch sealing. Thus, it is desirable that the size of the weld mark be equal to or greater than 0.07 $mm^2$, at or above which a weld strength equal to or higher than 0.5 kgf is achieved.

Meanwhile, when the size of the weld mark exceeds 0.25 $mm^2$, the crack that runs from the vicinity of the weld mark occurs in the pinch seal portion and it becomes impossible to achieve the lifetime that is required of this kind of arc tube. Specifically, at the interface between the molybdenum foil and the glass layer, glass enters the weld mark and the bonding strength (adhesion) between the molybdenum foil and the glass layer is particularly high at the position of the weld mark, so that the thermal stress (thermal strain) that occurs at the time of turning on or off the bulb (arc tube) concentrates at the entering portion, at which the glass layer enters the weld mark. For the reason as described above, it is considered that, when the size of the weld mark exceeds 0.25 $mm^2$, the crack that runs from the vicinity of the weld mark occurs in the glass layer (pinch seal portion).

Specifically, in the lifetime test, in which the arc tube is switched on and off repeatedly until the amount of emission of light falls below a predetermined amount, the size of the weld mark and the lifetime of the arc tube (the time, at which a crack occurs in the pinch seal portion) are substantially inversely proportional to each other as shown in FIG. 9 (the smaller the size of the weld mark is, the less a crack occurs in the spot welded portion).

The lifetime of this kind of arc tube is generally required to be equal to or longer than 2500 hours and therefore, it is desirable that the size of the weld mark be equal to or less than 0.25 $mm^2$ so that a lifetime equal to or longer than 2500 hours is achieved.

Thus, it is desirable that when the electrode bar and the molybdenum foil are spot welded, the size of the weld mark in the molybdenum foil on the side opposite to the joint portion, at which the molybdenum foil and the electrode bar are joined with each other, be set within a range from 0.07 $m^2$ to 0.25 $mm^2$ so that the bonding strength of the spot welded portion between the electrode bar and the molybdenum foil enough to withstand the pinch sealing pressure is secured and it is possible to prevent a crack that runs from the vicinity of the weld mark of the weld between the molybdenum foil and the electrode bar from occurring in the pinch seal portion even after the arc tube for a discharge bulb has been used for a long period of time. Note that the size of the weld mark can be controlled by adjusting the size of the welding electrode and/or the electric power for welding.

As is clear from the above description, with the arc tube for a discharge bulb according to the first aspect of the present invention, by adjusting the size of the weld mark in the molybdenum foil on the side opposite to the joint portion, at which the molybdenum foil and the electrode bar are joined with each other, first, the yield in manufacturing the arc tube for a discharge bulb is improved because the problem that the electrode bar and the molybdenum foil come off each other, are deformed, etc. at the spot welded portion when the electrode assembly is pinch-sealed, does not occur.

Second, since the crack that runs from the vicinity of the weld mark of the weld between the molybdenum foil and the electrode bar does not occur in the pinch seal portion even after the arc tube for a discharge bulb has been used for a long period of time, a long-life arc tube for a discharge bulb is provided.

According to the discharge bulb of the second aspect of the present invention, a high-yield, long-life discharge bulb is obtained by using the high-yield, long-life arc tube.

BRIEF DESCRIPTION OF THE DRAWINGS

Features, advantages, and technical and industrial significance of exemplary embodiments of the present invention will be described below with reference to the accompanying drawings, in which like numerals denote like elements, and wherein.

DETAILED DESCRIPTION OF EMBODIMENTS

Embodiments of the present invention will be described with reference to the drawings.

Figure 1:
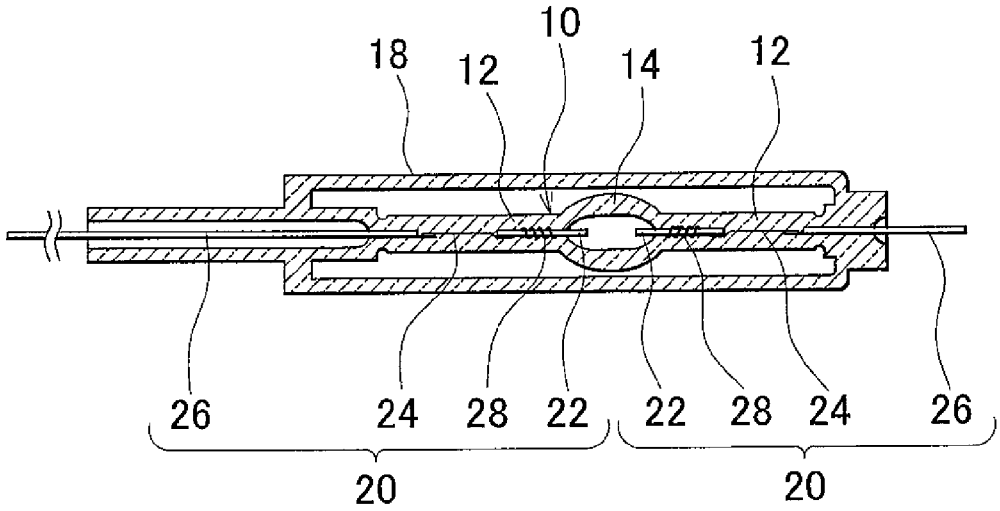
FIG. 1 is a sectional side view of an arc tube for a discharge bulb, which is a first embodiment of the present invention, with a molybdenum foil being in a horizontally laid state.
Figure 2:
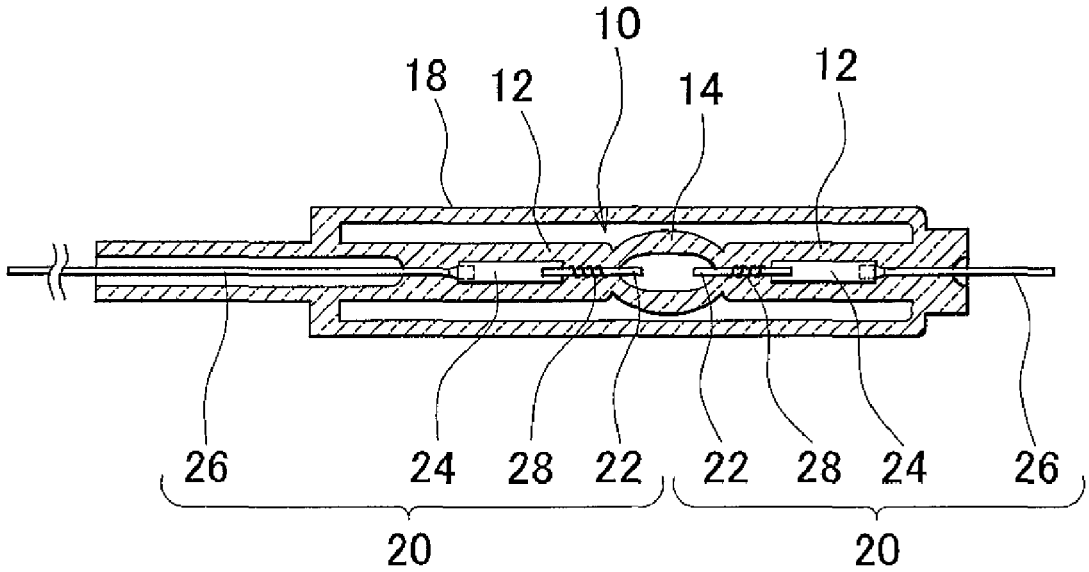
FIG. 2 is a sectional side view of the arc tube for a discharge bulb with the molybdenum foil being in an upright state.
Figure 3:
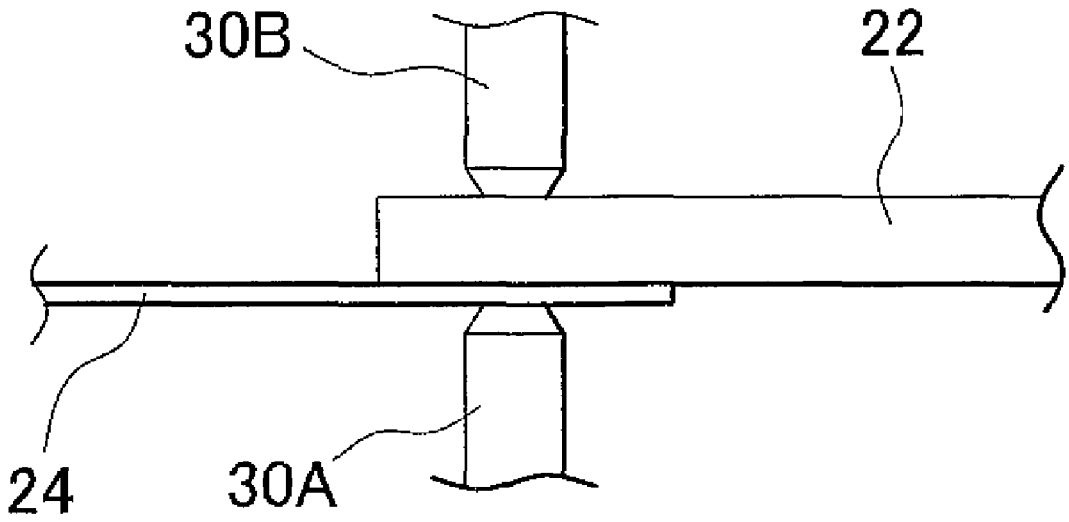
FIG. 3 is a diagram showing a method of manufacturing an electrode assembly (method of welding an electrode bar and the molybdenum foil)
Figure 4:
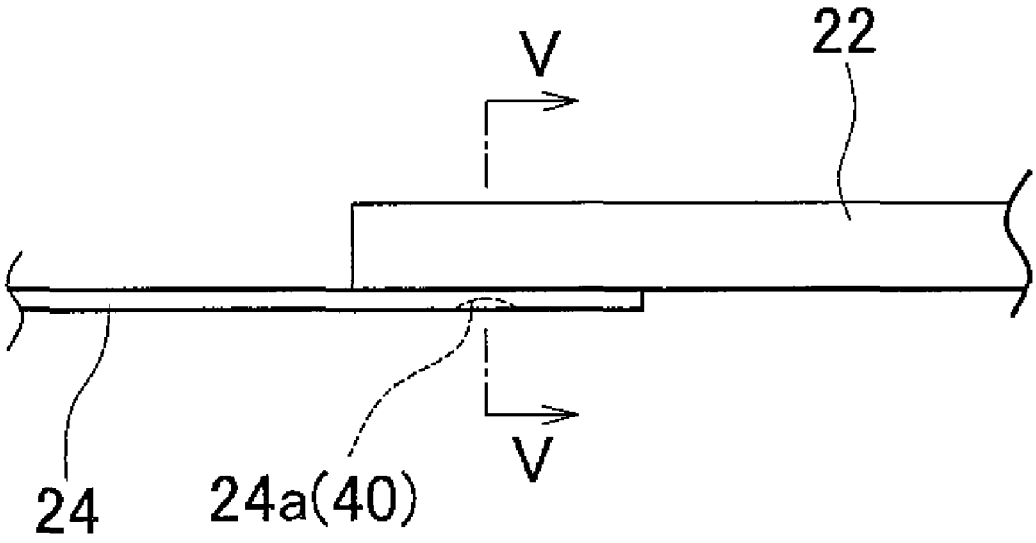
FIG. 4 is a side view of an important portion of the electrode assembly (weld portion at which the electrode bar and the molybdenum foil are welded)
Figure 5:
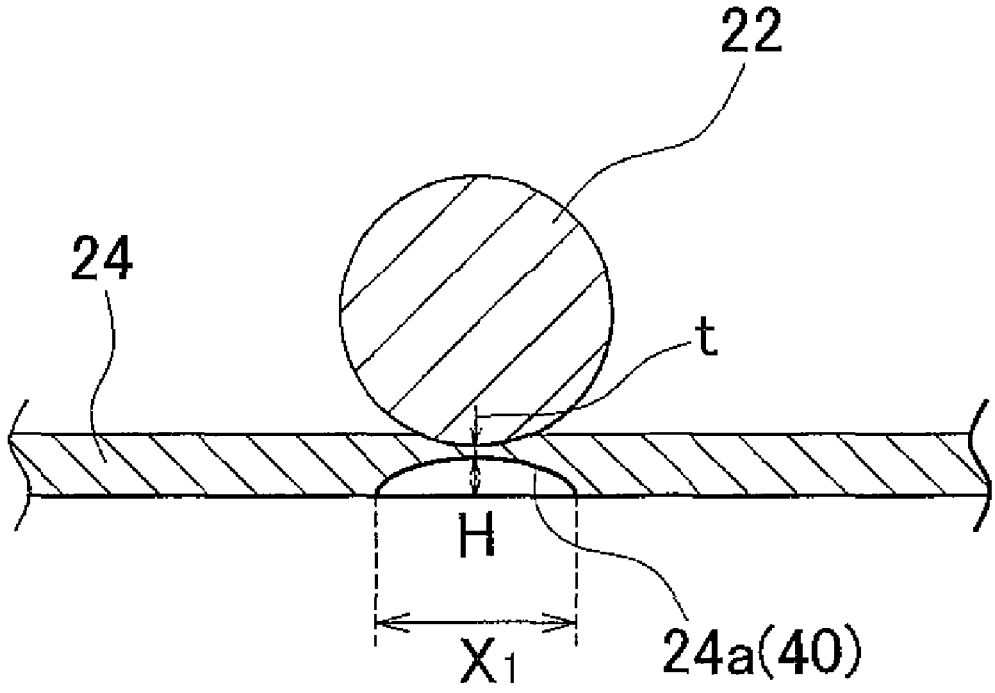
FIG. 5 is an enlarged cross section (cross section taken along the line V-V shown in FIG. 4) of the important portion of the electrode assembly (weld portion at which the electrode bar and the molybdenum foil are welded)
Figure 6:
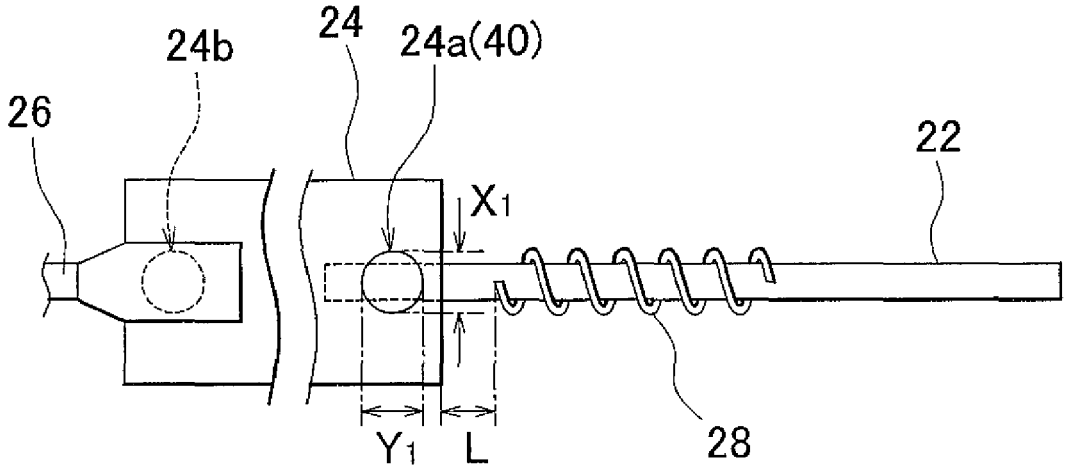
FIG. 6 is a plan view of the important portion of the electrode assembly.
Figure 7:
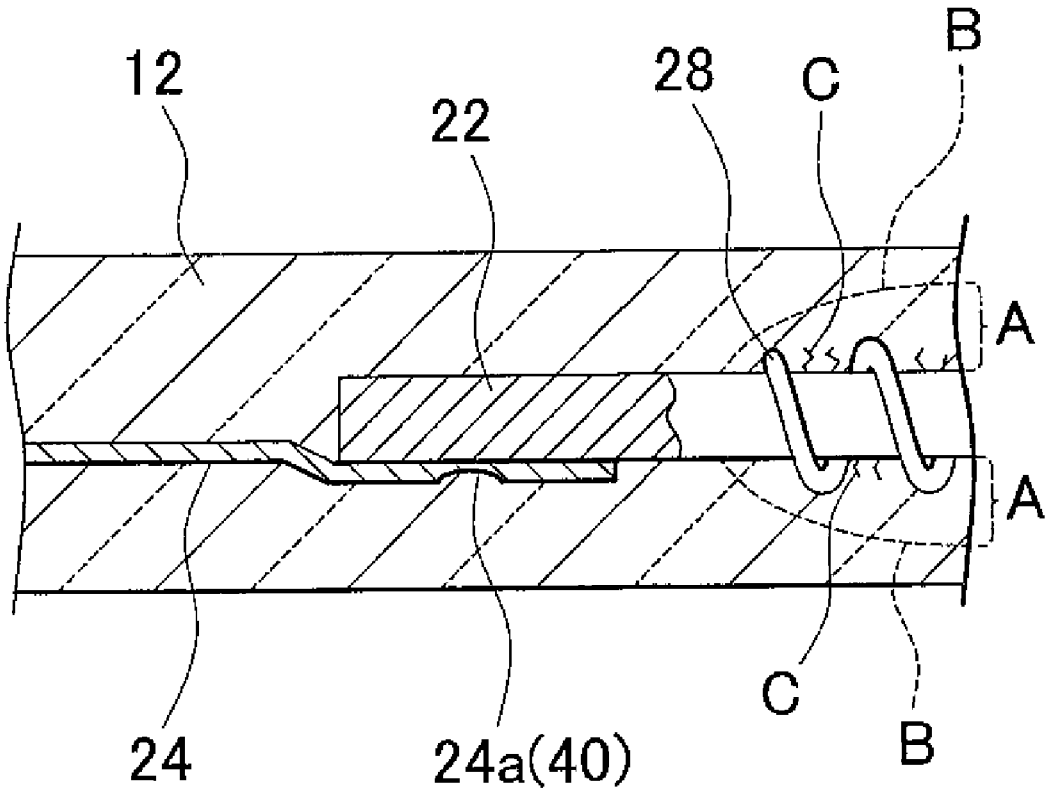
FIG. 7 is a longitudinal section of a pinch seal portion at the weld portion at which the electrode bar and the molybdenum foil are welded.

FIGS. 1 and 2 are sectional side views of an arc tube for a discharge bulb, which is an embodiment of the present invention. FIG. 1 is a longitudinal section of the arc tube with a molybdenum foil being in a horizontally laid state. FIG. 2 is a longitudinal section of the arc tube with the molybdenum foil being in an upright state. FIG. 3 is a diagram showing a method of manufacturing an electrode assembly (method of welding an electrode bar and the molybdenum foil). FIG. 4 is a side view of an important portion of the electrode assembly (weld portion at which the electrode bar and the molybdenum foil are welded). FIG. 5 is an enlarged cross section (cross section taken along the line V-V shown in FIG. 4) of the important portion of the electrode assembly (weld portion at which the electrode bar and the molybdenum foil are welded). FIG. 6 is a plan view of the important portion of the electrode assembly. FIG. 7 is a longitudinal section of a pinch seal portion at the weld portion at which the electrode bar and the molybdenum foil are welded.

In the arc tube for a discharge bulb shown in FIGS. 1 and 2, which is used in a light source bulb of a vehicular headlamp, an arc tube body 10, in which a closed glass bulb 14 serving as a discharge light-emitting portion is formed generally at the center of the arc tube body 10 in the longitudinal direction, and a shroud glass tube 18, having a pipe (cylindrical) shape, that surrounds the arc tube body 10, are integrally formed.

In the arc tube body 10, a quartz glass tube having an elongated cylindrical shape is processed to seal the electrode assembly 20 by a longitudinally aligned pair of pinch seal portions 12, 12, so that, in the closed glass bulb 14 between the pinch seal portion 12, the electrode bars 22, 22 are disposed so as to be opposed to each other and a metal halide or the like, which is a luminous substance, along with a starting inert gas is enclosed. However, mercury, which serves as a buffer gas to raise tube voltage, is not enclosed in the closed glass bulb 14. Specifically, the arc tube body 10 is a mercury-free arc tube.

More specifically, the starting inert gas is enclosed in the closed glass bulb 14 in order to, for example, facilitate discharge between the electrodes. In this embodiment, xenon gas (Xe) is used. Metal halide is enclosed to improve the luminous efficiency and color rendering properties. In this embodiment, sodium iodide and scandium iodide are used.

Mercury has a buffering function of reducing the number of collisions of electrons with the electrode to lessen the damage of the electrode and this function is lost when the arc tube is mercury-free. In this embodiment, however, a buffering metal halide, which serves as a substitute for mercury having the buffering function, is enclosed, although the amount of buffering metal halide enclosed is smaller than the amount of the metal halide that is the luminous substance. One or more of halides of Al, Bi, Cr, Cs, Fe, Ga, In, Li, Mg, Ni, Nd, Sb, Sn, Ti, Tb, Zn, etc. are used as the buffering metal halide.

In each of the electrode assemblies 20, the electrode bar 22 made of tungsten and a lead wire 26 made of molybdenum are connected straight via the molybdenum foil 24. A part, including at least the molybdenum foil 24, of the electrode assembly 20, more specifically, a part of the electrode assembly 20 that extends from part of the electrode bar 22 to part of the lead wire 26, is pinch-sealed in the pinch seal portion 12. The tip portions of the pair of electrode bars 22 that protrude from the pinch seal portions 12 into the closed glass bulb 14 form the opposed electrodes in the discharge light-emitting portion and an arc that is curved so as to be convex upward is generated by the discharge between the electrodes.

Reference numeral 28 indicates a tungsten coil that is wound around the electrode bar 22 at a position biased toward the molybdenum foil 24, the electrode bar 22 being pinch-sealed in the pinch seal portion 12. The tungsten coil, described in detail later, is effective in suppressing the occurrence of an electrode crack (a crack that occurs where the electrode bar 22 is sealed) in the pinch seal portion 12

An inert gas that is used to create a vacuum or insulating space is enclosed (charged) in the shroud glass tube 18 that surrounds the closed glass bulb 14 of the arc tube body 10. The pressure of the enclosed (charged) inert gas is set at a negative pressure (approximately 0.5 atm., for example) from 0 (vacuum) to 0.9 atm.

Joining the shroud glass tube 18 to the arc tube body 10 in a sealed manner is performed by melting one end portion of the shroud glass tube 18 to stick it to the arc tube body 10, charging the inert gas into the shroud glass tube 18, and then melting the other end portion of the shroud glass tube 18 to stick it to the arc tube body 10.

Next, a structure of the electrode assembly 20 will be described in detail.

As shown in FIG. 6 in an enlarged manner, the electrode assembly 20 is formed by resistance-spot welding the electrode bar 22 and the lead wire 26 to longitudinal ends of the molybdenum foil 24 in series, the molybdenum foil 24 being a rectangular foil with a width of 1.5 mm, a length of 7.25 mm, and a thickness of 20 μm, the electrode bar being a round bar with a diameter of 0.30 mm and a length of 8 mm, the lead wire 26 being a round bar with a diameter of 0.45 mm and a length of 43 mm.

Reference numeral 24*a* indicates the spot welded portion, at which the modybdenum foil 24 and the electrode bar 22 are spot welded to each other and reference numeral 24*b* indicates the spot welded portion, at which the molybdenum foil 24 and the lead wire 26 are spot welded to each other.

As shown in FIG. 5 in an enlarged manner, the spot welded portion 24*a* is a weld mark (recess) 40, called a nugget, that is formed in the molybdenum foil 24 on the side opposite to the joint portion, at which the molybdenum foil 24 and the electrode bar 22 are joined with each other.

The nugget 40, described in detail later, has a size (X1·Y1) within a range from 0.07 $mm^2$ to 0.25 $mm^2$ and an average depth H equal to or less than 15 μm, and a structure is provided, in which a bonding strength enough to prevent the electrode bar 22 and the molybdenum foil 24 from coming off each other when the electrode assembly 20 is pinch-sealed, and in which the electrode crack that runs from the vicinity of the nugget 40 does not occur in the pinch seal portion 12 even after the arc tube have been used for a long period of time.

In addition, a coil 28 having a inner diameter (0.35 mm, for example) that is slightly greater than the outer diameter of the electrode bar 22 is integrally fitted onto the electrode bar 22 at a position biased toward the molybdenum foil 24 so that the coil 28 is spaced apart from the end of the molybdenum foil 24 by a predetermined distance (0.4 mm, for example). The coil 28 is made of tungsten and is formed to have a 0.3-mm pitch.

In order to manufacture the electrode assembly 20, as shown in FIG. 3, an end portion of the molybdenum foil 24 is placed on a lower welding electrode 30A and an end portion of the electrode bar 22 is placed on the molybdenum foil 24. Next, an upper welding electrode 30B is lowered to cause the pair of lower and upper welding electrodes 30A and 30B to sandwich the overlapping portion of the molybdenum foil 24 and the electrode bar 22 at the position that is spaced apart from the end of the electrode bar 22 by a predetermined distance, and an electric current is caused to flow between the welding electrodes 30A and 30B to spot weld the overlapping portion of the molybdenum foil 24 and the electrode bar 22.

Next, in a manner similar to that in the case of welding the electrode bar 22, the overlapping portion of the molybdenum foil 24 and the lead wire 26 is sandwiched, by the electrodes, at a predetermined position with a little margin at the end of the lead wire 26 left, and then the lead wire 26 is spot welded to the other end portion of the molybdenum foil 24.

Lastly, a coil 28 is integrally fitted onto the electrode bar 22 at a position biased toward the molybdenum foil 24. During this, if at least one of both ends of the coil 28 is welded to the electrode bar 22 in advance, the coil 28 is not axially displaced with respect to the electrode when the electrode assembly 20 is pinch-sealed.

Note that with regard to the process of welding the electrode bar 22 and the lead wire 26 to the molybdenum foil 24, the lead wire 26 may be welded to the molybdenum foil 24 first and then the electrode bar 22 may be welded thereto, or both of the lead wire 26 and the electrode bar 22 may be welded to the molybdenum foil 24 at once.

Figure 8:
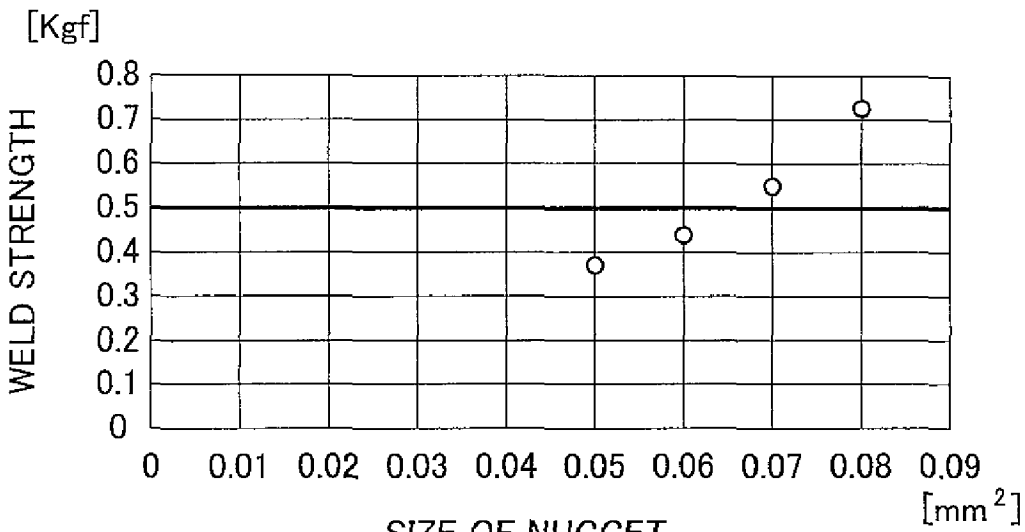
FIG. 8 is a diagram showing results of strength tests for the electrode assembly.

FIG. 8 is a diagram showing a relation between the size of the nugget 40, which is the spot welded portion (joint portion between the electrode and the molybdenum foil), and the weld strength of the spot welded portion.

Ten electrode assemblies that are different in size of the nugget 40 were prepared and the "tensile test", in which the electrode bar and the molybdenum foil were pulled in the axial direction, was conducted for each of the electrode assemblies. As a result, as shown in FIG. 8, the size of the nugget 40 and the weld strength of the spot welded portion are substantially proportional to each other (the larger the size of the nugget 40 is, the higher the weld strength of the spot welded portion is).

Since the pinch sealing pressure is 0.5 kgf, it is desirable that the weld strength of the spot welded portion be higher than the pinch sealing pressure (0.5 kgf). This is because, when the weld strength is equal to or lower than 0.5 kgf, bonding strength (weld strength) is insufficient and therefore, the molybdenum foil 24 and the electrode bar 22 can come off each other when the electrode assembly 20 is pinch-sealed. As a result, the electrode assembly 20 does not function as the path for electric current (the arc tube is not lit). Thus, in order to prevent the molybdenum foil 24 and the electrode bar 22 from coming off each other when the electrode assembly 20 is pinch-sealed, it is desirable that the size of the nugget 40 be equal to or greater than 0.07 $mm^2$, at or above which the weld strength exceeds 0.5 kgf.

Figure 9:
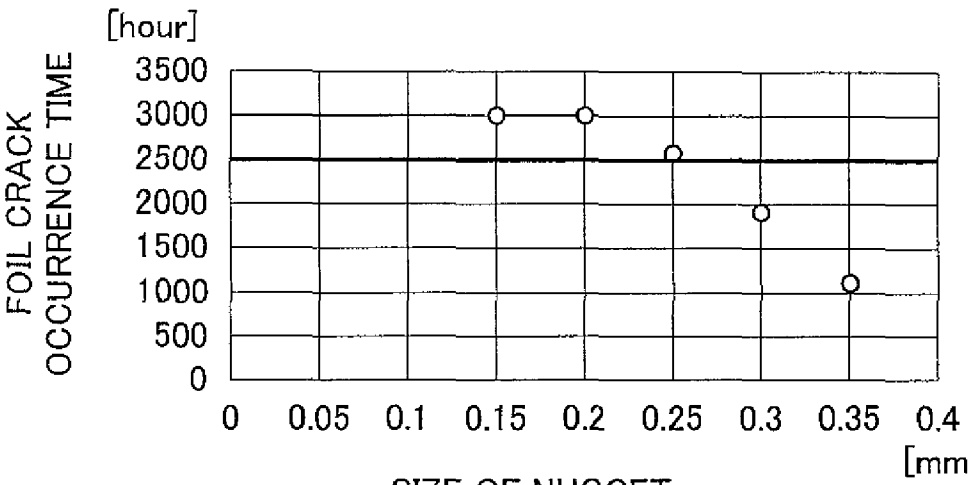
FIG. 9 is a diagram showing results of lifetime tests for the arc tube for a discharge bulb.

FIG. 9 is a diagram showing a relation between the size of the nugget 40, which is the spot welded portion, and the time, at which a foil crack occurs (lifetime of the arc tube).

Ten arc tubes having electrode assemblies pinch-sealed that were different in size of the nugget 40 were prepared and the "life test" was conducted, in which the arc tube is energized so as to be switched on and off repeatedly and the time, at which the foil crack occurs in the pinch seal portion, was measured. As shown in FIG. 9, the size (X1·Y1) of the nugget 40 and the time (lifetime of the bulb), at which a crack that runs from the vicinity of the nugget 40 occurs in the pinch seal portion, are substantially inversely proportional to each other (the smaller the size of the nugget 40 is, the less the foil crack occurs in the spot welded portion, that is, the longer the lifetime is).

When the size of the nugget 40 exceeds 0.25 $mm^2$, a crack that runs from the vicinity of the nugget 40 occurs in the pinch seal portion and it becomes impossible to achieve the lifetime that is required of this kind of arc tube. Specifically, at the interface between the molybdenum foil 24 and the glass layer, glass enters the nugget 40 and the bonding strength (adhesion) between the molybdenum foil and the glass layer is particularly high at the position of the nugget 40, so that the thermal stress (thermal strain) that occurs at the time of turning on or off the bulb (arc tube) concentrates at the entering portion, at which the glass layer enters the nugget 40. For the reason as described above, it is considered that, when the size of the nugget 40 exceeds 0.25 $mm^2$, a crack that runs from the vicinity of the nugget 40 occurs in the glass layer (pinch seal portion).

Meanwhile, the lifetime of this kind of arc tube is generally required to be equal to or longer than 2500 hours and therefore, it is desirable that the size of the nugget 40 be equal to or less than 0.25 $mm^2$ so that a lifetime equal to or longer than 2500 hours is achieved.

As described above, in this embodiment, the size of the nugget 40 is set within a range from 0.07 $m^2$ to 0.25 $mm^2$ so that the bonding strength of the spot welded portion between the electrode bar and the molybdenum foil enough to withstand the pinch sealing pressure is secured and it is possible to prevent the foil crack that runs from the vicinity of the nugget 40 of the weld between the molybdenum foil and the electrode bar from occurring in the pinch seal portion 12 even after the arc tube for a discharge bulb has been used for a long period of time.

In addition, in this embodiment, the average depth H of the nugget 40 is set equal to or less than 15 μm for the following reason.

First, in the pinch seal portion 12, glass enters the nugget 40, which is a recess, and the deeper the nugget 40 is, the more the thermal stress (thermal strain) that occurs at the time of turning on or off the discharge bulb (arc tube) concentrates at the entering portion, at which the glass layer enters the nugget 40, and the more easily the crack that runs from the vicinity of the nugget 40 occurs in the glass layer (pinch seal portion). Thus, in view of minimizing the influence of the concentration of the thermal stress (thermal strain) that occurs at the time of turning on or off the arc tube, the smaller the depth H (see FIG. 5) of the nugget 40 is, the better.

The thickness of the molybdenum foil 24 is generally 20 μm. In the case of the spot welding using resistance welding, when the average depth of the nugget 40 exceeds 15 μm, the thickness of the recrystallized layer of the molybdenum forming the nugget 40, which is a recess, becomes a small thickness less than 5 μm. In particular, the thickness t (see FIG. 5) of the part of the recrystallized layer of molybdenum along the electrode bar 22 becomes very thin and there is a possibility that the surface of the electrode bar 22 is exposed from the nugget 40, for example, which can result in an insufficient weld strength. Thus, deformation of the molybdenum foil 24 and/or breakage of the molybdenum foil 24 can occur at the weld between the molybdenum foil 24 and the electrode bar 22 when the electrode assembly 20 is pinch-sealed.

In this embodiment, however, the depth H of the nugget 40 is set equal to or less than 15 μm so that a sufficient thickness of the recrystallized layer of the molybdenum foil 24, which is the weld between the electrode bar 22 and the molybdenum foil 24, is secured and neither deformation of the molybdenum foil 24 nor breakage of the molybdenum foil 24 occurs at the weld between the molybdenum foil 24 and the electrode bar 22 when the electrode assembly 20 is pinch-sealed.

The wound coil 28 is wound around the electrode bar 22 with a predetermined pitch and the end of the molybdenum foil 24 and the wound coil 28 is spaced apart from each other by a distance equal to or less than 0.5 mm for the following reason.

This embodiment is a mercury-free arc tube, in which mercury effective in raising the tube voltage is not enclosed in the closed glass bulb 14, and therefore, in order to compensate for the reduced tube voltage as compared to the mercury-containing arc tube, the tube current is increased to obtain enough power. Thus, the electrode bar 22 with a large diameter is employed (for example, the diameter of the electrode is 0.25 mm in the case of the mercury-containing arc tube, whereas the diameter of the electrode is 0.30 mm in the case of the mercury-free arc tube) so that the electrode bar can withstand a large electric current with a sufficient margin. For this reason, the thermal stress (thermal strain) that occurs at the interface between the electrode bar 22 and the glass layer at the time of turning on or off the arc tube is greater than that in the case of the mercury-containing arc tube and therefore, a residual compression strain layer that occurs around the electrode bar 22 and a crack (hereinafter referred to as the "boundary crack") that runs along the circumferential direction and the axial direction so as to surround the residual compression strain layer are also greater in size than those in the case of the mercury-containing arc tube, so that the thickness of the glass layer outside the residual compression strain layer (or the boundary crack) becomes thin and there is a possibility that the electrode crack occurs that can cause the leakage of the enclosed substances through the boundary crack.

As described in JP-A-2001-1506, JP-A-2007-134055, and JP-A-2006-140135, for example, during the cooling process after the electrode assembly is pinch-sealed, the residual compression strain layer and the boundary crack occur in the glass layer around the electrode bar due to the difference in linear expansion between the electrode bar and the glass, and the residual compression strain layer and the boundary crack absorb and disperse the thermal stress that occurs in the glass layer in the pinch sealed portion at the time of turning on or off the arc tube and are therefore effective in suppressing the occurrence of an excessive thermal stress at the interface between the glass layer and the electrode bar. When the residual compression strain layer and the boundary crack extend as described above, however, the electrode crack that can cause the leakage of the enclosed substances easily occur in the thin glass layer outside the residual compression strain layer and the boundary crack.

In this embodiment, however, as shown in FIG. 7, although the residual compression strain layer A and the boundary crack B occur around the electrode bar 22 in the pinch seal portion 12 during the cooling process after the electrode assembly is pinch-sealed, small cracks C occur around the coil region of the electrode bar 22, around which the coil is wound, whereby the stress is relieved. As a result, the stress in the residual compression strain layer A that occurs around the electrode bar 22 is reduced, whereby extension of the boundary crack B is suppressed.

Thus, even in the case of the mercury-free arc tube, in which the large-diameter electrode bar 22 is used, the residual compression strain layer A and the boundary crack B that occur around the electrode bar 22 efficiently relieve (absorb) the thermal stress that occurs in the pinch seal portion 12 at the time of turning on or off the arc tube. In other words, the thermal stress that repeatedly occurs between the electrode bar 22 and the glass layer is absorbed or relieved by the residual compression strain layer A and the boundary crack B that are present around the coil region of the electrode bar 22, around which the coil is wound, and the thermal stress is then transmitted to the sufficiently thick glass layer outside the residual compression strain layer A (boundary crack B), so that the occurrence of the electrode crack, in the pinch seal portion 12, that can cause a leakage of the enclosed substances (the crack that extends from the electrode bar 22 to the surface of the pinch seal portion) is suppressed.

When the coil 28 is wound so that there is no interval between the adjacent coil wires, there is a possibility that a small gap that is continuous in the axial direction is formed between the electrode bar 22 and the wound coil 28, and the enclosed substances, such as the luminous substance, in the closed glass bulb 14 enter the small gap, which can change the light color of the arc tube and/or reduce the luminous efficiency.

In this embodiment, however, the coil is wound around the electrode bar 22 with a predetermined pitch (a 0.3-mm pitch, for example), so that, around the coil region, glass is in close contact with the surface of the electrode bar 22 between the adjacent coil wires and the gap formed between the coil 28 and the electrode bar 22 is not continuous in the axial direction. Thus, the problems of the change in the light color of the arc tube and the reduction in the luminous efficiency that are described above do not arise.

The wound coil 28 is disposed so as to be spaced apart from the end of the molybdenum foil 24, so that, even when the enclosed substances enter the small gap between the coil 28 and the electrode bar 22, the close contact interface between the glass layer and the surface of the electrode bar 22 that extends between the end of the molybdenum foil 24 and the coil 28 reliably prevents the enclosed substances from entering the interface between the molybdenum foil 24 and the glass layer, whereby the occurrence of the detachment of the foil is avoided.

Figure 10:
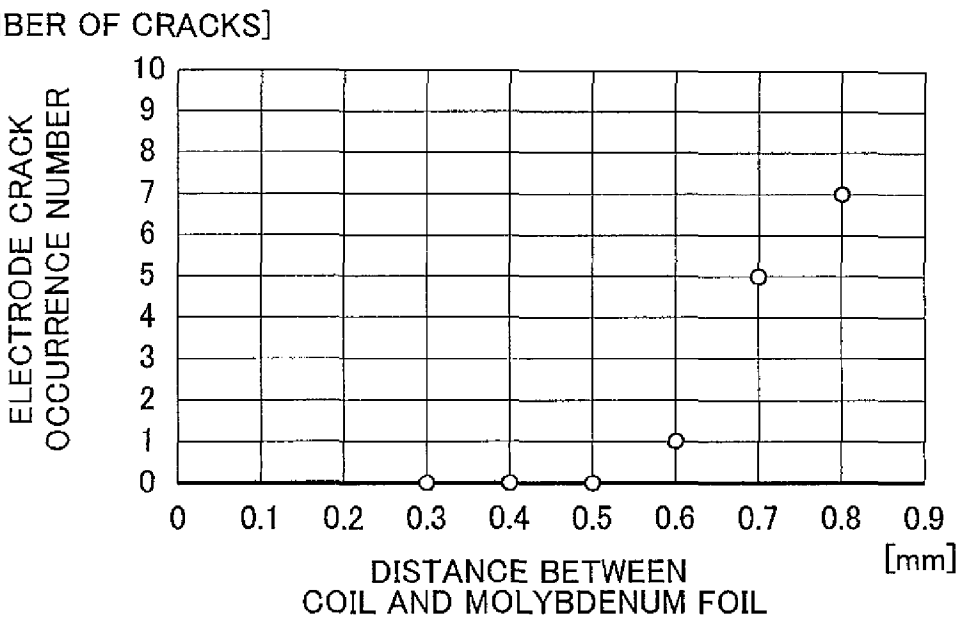
FIG. 10 is a diagram showing a relation between the distance between a coil and an end of the molybdenum foil and the occurrence of electrode cracks.

FIG. 10 shows a relation between the distance L between the coil and the end of the molybdenum foil and the occurrence of the electrode crack.

As shown in FIG. 10, the distance L between the coil and the end of the molybdenum foil and the number of occurrences of the electrode crack are substantially proportional to each other. Since, when the distance L between the coil and the end of the molybdenum foil exceeds 0.5 mm, the electrode crack occurs, and when the same distance L is equal to or lower than 0.5 mm, no electrode crack occurs at all, it is desirable that the wound coil 28 be disposed so as to be spaced apart from the end of the molybdenum foil 24 by a distance equal to or less than 0.5 mm. Specifically, when the wound coil 28 is spaced apart from the end of the molybdenum foil 24 by a distance greater than 0.5 mm, a bead crack occurs in the glass layer around the electrode bar 22. In the mercury-free arc tube, an electrode bar is used that is thicker than that of the mercury-containing arc tube and therefore, the bead crack that occurs is also large, which increases the possibility of occurrence of the electrode crack.

Meanwhile, when the distance between the end of the molybdenum foil 24 and the wound coil 28 is zero, it is difficult to fit the coil 28 onto the electrode bar 22 and in addition, as described above, there is a possibility that the enclosed substances that have entered the small gap between the coil 28 and the electrode bar 22 enter the interface between the molybdenum foil 24 and the glass layer, which can result in the occurrence of detachment of the foil. Thus, it is desirable that the end of the molybdenum foil and the wound coil 28 be spaced apart from each other by a distance equal to or greater than a predetermined distance (equal to or greater than 0.2 mm, for example).

Thus, in this embodiment, the wound coil 28 is placed in a region within 0.5 mm of the end of the molybdenum foil 24, in which there is no fear that the electrode crack may occur, that is, the wound coil 28 is spaced apart from the end of the molybdenum foil 24 by 0.4 mm, for example.

Figure 11:
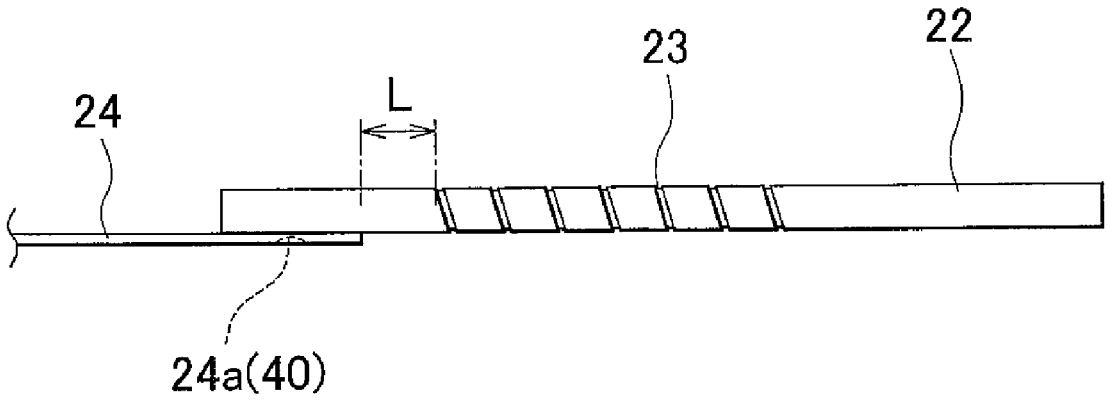
FIG. 11 is a partially enlarged side view of an electrode assembly, which is an important portion of an arc tube for a discharge bulb according to a second embodiment of the present invention.

FIG. 11 is a partially enlarged side view of an electrode assembly, which is an important portion of an arc tube for a discharge bulb according to a second embodiment of the present invention.

In the first embodiment described above, the coil 28 is wound around the electrode bar 22 that is sealed by the pinch seal portion 12, whereas in the second embodiment, a spiral groove 23 with the same pitch as that of the coil 28 of the first embodiment is formed in the outer circumferential surface of the electrode bar 22.

As in the case of the coil 28 of the first embodiment, the spiral groove 23 suppresses extension of the residual compression strain layer and the boundary crack that occur around the electrode bar 22 in the pinch seal portion 12 during the cooling process after the electrode assembly is pinch-sealed.

Specifically, around the region on the electrode bar 22, in which the spiral groove 23 is formed, fine small cracks occur in the glass layer between the grooves adjacent to each other in the axial direction of the electrode bar 22, so that extension of the residual compression strain layer and the boundary crack that occur around the electrode bar 22 is suppressed.

Figure 12:
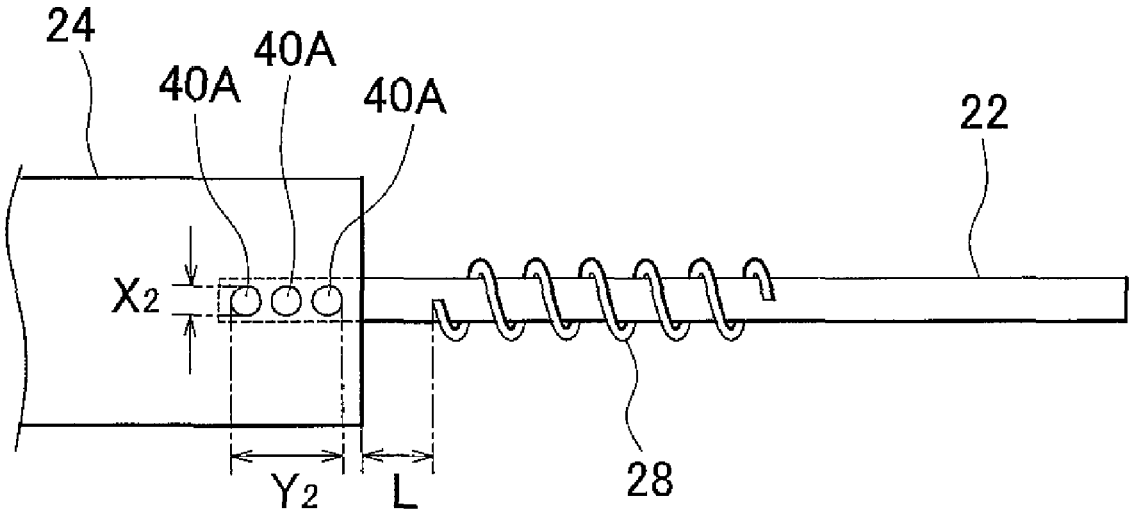
FIG. 12 is a partially enlarged plan view of an electrode assembly, which is an important portion of an arc tube for a discharge bulb according to a third embodiment of the present invention.

FIG. 12 is a partially enlarged plan view of an electrode assembly, which is an important portion of an arc tube for a discharge bulb according to a third embodiment of the present invention.

In the first and second embodiments described above, each of the overlapping portion of the molybdenum foil 24 and the electrode bar 22 and the overlapping portion of the molybdenum foil 24 and the lead wire 26 is joined by resistance welding. In the third embodiment, of the overlapping portion of the molybdenum foil 24 and the electrode bar 22 and the overlapping portion of the molybdenum foil 24 and the lead wire 26, at least the overlapping portion of the molybdenum foil 24 and the electrode bar 22 is joined by laser welding, in which laser light is applied to the molybdenum foil 24 from the back thereof to perform spot welding. Illustration of the spot welded portion between the molybdenum foil 24 and the lead wire 26 is omitted.

The diameter of the spot of the laser that is used to perform laser welding is small and therefore, a nugget 40A that appears in the molybdenum foil 24 on the side opposite to the joint portion, at which the molybdenum foil 24 and the electrode bar 22 are joined with each other, is relatively smaller than the size of the nugget 40 that appears in the case of the resistance welding.

For this reason, in the case of the spot welding using laser welding, in order to secure a sufficient weld strength at the joint portion, at which the molybdenum foil 24 is joined to the electrode bar 22, welding is performed at a plurality of points (three points in this embodiment) along the electrode bar 22 and therefore, three nuggets 40A are formed along the electrode bar 22 in the molybdenum foil 24 on the side opposite to the joint portion between the molybdenum foil 24 and the electrode bar 22, at which the molybdenum foil 24 is joined to the electrode bar 22.

The size (X2·Y2) of the entire region, in which a line of three nuggets 40A is formed, is set within a range from 0.07 $m^2$ to 0.25 $mm^2$.

Specifically, in this embodiment, the size of the entire region, in which the three nuggets 40A are formed, is set within a range from 0.07 $m^2$ to 0.25 $mm^2$ so that the bonding strength of the spot welded portion between the electrode bar and the molybdenum foil enough to withstand the pinch sealing pressure is secured and it is possible to prevent the foil crack that runs from the vicinity of the nugget 40A of the weld between the molybdenum foil and the electrode bar from occurring in the pinch seal portion even after the arc tube for a discharge bulb has been used for a long period of time.

The third embodiment is similar to the above-described first embodiment on the other points and therefore, the same reference numerals are assigned to the corresponding elements to omit the redundant description.

In the arc tube for a discharge bulb as described above, the average depth of the weld mark (recess) may be equal to or less than 15 μm. The spot welding may be resistance welding. The spot welding may be laser welding. In the case of the laser welding, a plurality of weld marks (recesses) can be easily formed. In the present invention, the size of such a plurality of recesses is expressed by the product of the length and the width of the entire region, in which the plurality of recesses are formed. When the plurality of recesses are arranged irregularly and it is difficult to define the entire region, in which the recesses are formed, by a rectangular shape, the entire region, in which recesses are formed, may be defined by a polygon, such as a combination of the rectangles each being circumscribed around the recess and the area of the entire region may be regarded as the size of the plurality of recesses. In this case, this size of the plurality of recesses may be within the range from 0.07 $mm^2$ to 0.25 $mm^2$.

In the pinch seal portion, glass enters the weld mark in the molybdenum foil on the side opposite to the joint portion, at which the molybdenum foil and the electrode bar are joined with each other, and the deeper the weld mark is, the more the thermal stress (thermal strain) that occurs at the time of turning on or off the discharge bulb (arc tube) concentrates at the entering portion, at which the glass layer enters the weld mark and the more easily a crack that runs from the vicinity of the weld mark occurs in the glass layer (pinch seal portion). For this reason, in order to minimize the influence of the concentration of the thermal stress (thermal strain) that occurs at the time of turning on or off the arc tube, the smaller the depth of the weld mark is, the better.

The thickness of the molybdenum foil is generally 20 μm. When the average depth of the weld mark (recess) exceeds 15 μm, the thickness of the recrystallized layer of the molybdenum forming the weld mark becomes a small thickness less than 5 μm. In particular, the thickness of the part of the recrystallized layer of molybdenum along the electrode bar becomes very thin and there is a possibility that the surface of the electrode bar is exposed from the weld mark, for example, which can result in an insufficient weld strength. Thus, deformation of the molybdenum foil and/or breakage of the molybdenum foil can occur at the weld between the molybdenum foil and the electrode bar (joint portion) when the electrode assembly is pinch-sealed.

Thus, in order to secure a sufficient thickness of the recrystallized layer of the molybdenum foil, which is the weld between the electrode bar and the molybdenum foil to prevent deformation of the molybdenum foil and breakage of the molybdenum foil from occurring at the weld between the molybdenum foil and the electrode bar when the electrode assembly is pinch-sealed, it is desirable that the average depth of the recess be set equal to or less than 15 μm.

When the average depth of the recess is set equal to or less than 15 μm, the recrystallized layer of molybdenum with a sufficient thickness is secured at the weld between the molybdenum foil and the electrode bar, so that the problem that the molybdenum foil is deformed, broken, etc. at the weld between the molybdenum foil and the electrode bar when the electrode assembly is pinch-sealed, does not occur. Thus, the yield in manufacturing the arc tube for a discharge bulb is further improved.

The arc tube for a discharge bulb may further include a coil that is wound with a predetermined pitch around the part of the electrode bar that is sealed in the pinch seal portion, wherein the coil and the molybdenum foil are spaced apart from each other.

In particular, in the case of the mercury-free arc tube, in which mercury effective in raising the tube voltage is not enclosed in the closed glass bulb, in order to compensate for the reduced tube voltage as compared to the mercury-containing arc tube, the tube current is increased to obtain enough power. Thus, the electrode bar with a large diameter is employed (for example, the diameter of the electrode is 0.25 mm in the case of the mercury-containing arc tube, whereas the diameter of the electrode is 0.30 mm in the case of the mercury-free arc tube) so that the electrode bar can withstand a large electric current with a sufficient margin. For this reason, the thermal stress (thermal strain) that occurs at the interface between the electrode bar and the glass layer at the time of turning on or off the arc tube is greater than that in the case of the mercury-containing arc tube and therefore, the residual compression strain layer that occurs around the electrode bar and the crack (hereinafter referred to as the "boundary crack") that runs along the circumferential direction and the axial direction so as to surround the residual compression strain layer are also greater in size than those in the case of the mercury-containing arc tube, so that the thickness of the glass layer outside the residual compression strain layer (or the boundary crack) is correspondingly reduced and there is a possibility that the electrode crack occurs that can cause the leakage of the enclosed substances through the boundary crack.

As described in JP-A-2001-1506, JP-A-2007-134055, and JP-A-2006-140135, for example, during the cooling process after the electrode assembly is pinch-sealed, the residual compression strain layer and the boundary crack occur in the glass layer around the electrode bar due to the difference in linear expansion between the electrode bar and the glass, and the residual compression strain layer and the boundary crack absorb and disperse the thermal stress that occurs in the glass layer in the pinch sealed portion at the time of turning on or off the arc tube and are therefore effective in suppressing the occurrence of an excessive thermal stress at the interface between the glass layer and the electrode bar. When the residual compression strain layer and the boundary crack extend as described above, however, the electrode crack that can cause the leakage of the enclosed substances easily occur in the thin glass layer outside the residual compression strain layer and the boundary crack.

However, although the residual compression strain layer and the boundary crack occur during the cooling process after the electrode assembly is pinch-sealed, around the coil region of the electrode bar, the small cracks occur in the glass layer between adjacent coil wires, whereby the stress is relieved and the stress in the residual compression strain layer that occurs around the electrode bar is also reduced, which suppresses extension of the boundary crack.

When the coil is wound so that there is no interval between the adjacent coil wires, there is a possibility that a small gap that is continuous in the axial direction is formed between the electrode bar and the wound coil, and the enclosed substances, such as the luminous substance, in the discharge light-emitting portion (closed glass bulb) enter the small gap, which can change the light color of the arc tube and/or reduce the luminous efficiency.

However, when the coil is wound around the electrode bar with a predetermined pitch (a 0.3-mm pitch, for example), around the coil region, glass layer is in close contact with the surface of the electrode bar between the adjacent coil wires and the gap formed between the coil and the electrode bar is not continuous in the axial direction. Thus, the problems of the change in the light color of the arc tube and the reduction in the luminous efficiency that are described above do not occur.

In addition, the wound coil is disposed so as to be spaced apart from the molybdenum foil, so that, even when the enclosed substances and the like enter the small gap between the coil and the electrode bar, the close contact interface between the glass layer and the surface of the electrode bar that extends between the molybdenum foil and the coil reliably prevents the enclosed substances and the like from entering the interface between the molybdenum foil and the glass layer, whereby the occurrence of detachment of the foil is avoided.

FIG. 10 shows a relation between the distance between the coil and the molybdenum foil and the crack occurrence number. Since, when the distance between the coil and the molybdenum foil exceeds 0.5 mm, the electrode crack occurs, and when the same distance is equal to or lower than 0.5 mm, no electrode crack occurs at all, it is desirable that the wound coil be disposed so as to be spaced apart from the molybdenum foil by a distance equal to or less than 0.5 mm. When the coil is spaced apart from the molybdenum foil by a distance greater than 0.5 mm, a bead crack occurs in the glass layer around the electrode bar. In the mercury-free arc tube, an electrode bar is used that is thicker than that of the mercury-containing arc tube and therefore, the bead crack that occurs is also large, which increases the possibility of occurrence of the electrode crack.

Meanwhile, when the distance between the molybdenum foil and the wound coil is zero, it is difficult to fit the coil onto the electrode bar and in addition, as described above, there is a possibility that the enclosed substances that have entered the small gap between the coil and the electrode bar enter the interface between the molybdenum foil and the glass layer, which can result in the occurrence of detachment of the foil. Thus, it is desirable that the molybdenum foil and the wound coil be spaced apart from each other by a distance equal to or greater than a predetermined distance (equal to or greater than 0.2 mm, for example).

When the arc tube for a discharge bulb further includes a coil that is wound with a predetermined pitch around the part of the electrode bar that is sealed in the pinch seal portion, and the coil and the molybdenum foil are spaced apart from each other, since the occurrence of the crack that runs from the vicinity of the weld mark of the weld between the molybdenum foil and the electrode bar in the pinch seal portion is suppressed even after the mercury-free arc tube for a discharge bulb has been used for a long period of time, a long-life, mercury-free arc tube for a discharge bulb is provided.

The arc tube for a discharge bulb may further include, instead of the coil, a spiral groove that is formed with a predetermined pitch in the part of the electrode bar that is sealed in the pinch seal portion, wherein the spiral groove and the molybdenum foil are spaced apart from each other. The distance between the spiral groove and the molybdenum foil may be equal to or less than 0.5 mm for the reason similar to that described above. The distance between the spiral groove and the molybdenum foil may be equal to or greater than 0.2 mm for the reason similar to that described above.

When the arc tube for a discharge bulb is a mercury-free arc tube, in which mercury, which serves as a buffer gas to raise tube voltage, is not enclosed, it can be expected that a particularly significant effect is brought about.

The present invention has been described with reference to example embodiments for illustrative purposes only. It should be understood that the description is not intended to be exhaustive or to limit form of the present invention and that the present invention may be adapted for use in other systems and applications. The scope of the present invention embraces various modifications and equivalent arrangements that may be conceived by one skilled in the art.

What is claimed is:

1. An arc tube for a discharge bulb comprising:

an electrode assembly that includes an electrode bar and a molybdenum foil, wherein an overlapping portion of an end portion of the electrode bar and a molybdenum foil is joined by spot welding;

a pinch seal portion that seals a part of the electrode assembly, the part including at least the molybdenum foil; and a closed glass bulb, into which a tip of the electrode bar protrudes, the closed glass bulb forming a discharge light-emitting portion, wherein a size of a recess, which is a weld mark, in the molybdenum foil on a side opposite to a joint portion, at which the molybdenum foil and the electrode bar are joined with each other, is within a range from 0.07 $mm^2$ to 0.25 $mm^2$.

2. The arc tube for a discharge bulb according to claim 1, wherein an average depth of the recess is equal to or less than 15 μm.

3. The arc tube for a discharge bulb according to claim 1, wherein the spot welding is resistance welding.

4. The arc tube for a discharge bulb according to claim 1, wherein the spot welding is laser welding.

5. The arc tube for a discharge bulb according to claim 4, wherein a size of a plurality of the recesses is within the range from 0.07 $mm^2$ to 0.25 $mm^2$.

6. The arc tube for a discharge bulb according to claim 1, further comprising a coil that is wound with a predetermined pitch around the part of the electrode bar that is sealed in the pinch seal portion, wherein the coil and the molybdenum foil are spaced apart from each other.

7. The arc tube for a discharge bulb according to claim 6, wherein a distance between the coil and the molybdenum foil is equal to or less than 0.5 mm.

8. The arc tube for a discharge bulb according to claim 6, wherein a distance between the coil and the molybdenum foil is equal to or greater than 0.2 mm.

9. The arc tube for a discharge bulb according to claim 1, further comprising a spiral groove that is formed with a predetermined pitch in the part of the electrode bar that is sealed in the pinch seal portion, wherein the spiral groove and the molybdenum foil are spaced apart from each other.

10. The arc tube for a discharge bulb according to claim 9, wherein a distance between the spiral groove and the molybdenum foil is equal to or less than 0.5 mm.

11. The arc tube for a discharge bulb according to claim 9, wherein a distance between the spiral groove and the molybdenum foil is equal to or greater than 0.2 mm.

12. The arc tube for a discharge bulb according to claim 1, wherein the arc tube for a discharge bulb is a mercury-free arc tube, in which mercury, which serves as a buffer gas to raise tube voltage, is not enclosed.

13. A discharge bulb comprising the arc tube for a discharge bulb according to claim 1.

* * * * *